United States Patent [19]

Pierce

[11] 4,193,136

[45] Mar. 18, 1980

[54] SPLIT WAISTBAND PANTS

[75] Inventor: Kenney J. Pierce, El Paso, Tex.

[73] Assignee: Farah Manufacturing Company, Inc., El Paso, Tex.

[21] Appl. No.: 888,957

[22] Filed: Mar. 22, 1978

[51] Int. Cl.[2] ..... A41F 9/02

[52] U.S. Cl. ..... 2/237

[58] Field of Search ..... 2/237, 221, 236, 220, 2/70

[56] References Cited

U.S. PATENT DOCUMENTS

| | | | |
|---|---|---|---|
| 2,541,713 | 2/1951 | Neilson | 2/237 |
| 3,098,238 | 7/1963 | Diamond | 2/237 |
| 3,638,242 | 2/1972 | Herter | 2/237 |

FOREIGN PATENT DOCUMENTS

| | | | |
|---|---|---|---|
| 2119806 | 11/1972 | Fed. Rep. of Germany | 2/237 |
| 1444054 | 7/1976 | United Kingdom | 2/237 |

*Primary Examiner*—H. Hampton Hunter

*Attorney, Agent, or Firm*—Curtis, Morris & Safford

[57] ABSTRACT

A split waistband garment with the improvement residing in the waistband construction whereby the front panel and rear panel of a pant leg are slidably, yet restrainingly, held together by a slider device.

7 Claims, 7 Drawing Figures

SPLIT WAISTBAND PANTS

This invention relates to pants and, more particularly, to an improved construction of split waistband pants, especially men's or boys' pants made to fit certain sizes, but provided for an adjustment due to increase or decrease of weight or extra clothing worn under the garment. Split waistband pants are garments which have an interrupted waistband such as at a side seam on each side of the pants with either back or front panel of a pant leg including its waistband portion overlapping each other.

BACKGROUND OF THE INVENTION

Men's pants are generally bought by size by the wearer of certain pants' size. A garment of a certain size can readily accommodate only slight changes in the wearer's waistline. For greater changes in the wearer's waistline, it is more desirable to have pants of a different size. However, replacement of a whole wardrobe is costly. Hence, it has become increasingly more desirable to provide men's pants which can expand within certain limits depending on the waistline changes by the wearer due to increase in weight, physical activity, or the clothing which is worn under the pants.

BRIEF DISCUSSION OF THE PRIOR ART

A number of suggestions have been made for accommodating the expanding waistline of a wearer and split waistband pants have become an accepted garment considered desirable by a wearer for the above given reasons. Thus, U.S. Pat. Nos. 2,599,983; 2,526,813; 2,541,713; as well as 2,024,922 illustrate various split waistband arrangements with a pocket disposed alongside a seam of a pants leg.

Other construction features illustrating a split waistband are shown in U.S. Pat. Nos. 2,626,397; 3,812,541; 3,438,061; 3,638,242; 3,703,729; and 3,797,046.

BRIEF STATEMENT OF THE INVENTION

In accordance with the present invention, a further improvement in the split waistband is provided. A more readily and automatically adjustable split waistband garment has been provided. This garment has an improved split waistband with improved construction features obtained by a combination of a restraint means which prevents the expansion of the split waistband beyond a certain point so as not to damage the garment and a further strengthening member between the overlapped portions of a front panel and a back panel of a man's pant leg. In accordance with the invention, not only an aesthetically better appearing garment is provided, but also a more wear resistant, stronger, more adjustable and comfortable garment is provided to the wearer.

Thus, as now produced in accordance with the novel construction, pants provide to the wearer, at all times, an appearance of a trim fit without unsightly gathering of the overlapped front and back panel portions of the waistband in the vicinity of a split waistband and at the pocket portion thereof.

As a point of departure, the construction of the pants follows the construction shown in U.S. Pat. Nos. 2,599,983 and 2,541,713. However, in accordance with the improvements as disclosed herein, the present invention accomplishes a more wear resistant garment which allows the use of the pockets without unsightly distortion of the garment despite the positioning of the pockets at a seam or adjacent thereto. Any split waistband pants construction which would require the use of a pocket however situated is improved with the present invention. A restrained, controlled expansion and contraction are preserving the garment's durable life without rapid deterioration of an expandable waistband material. This expandable material is made of elastic components which have considerable longevity if not over expanded or unduly extended.

DETAILED DESCRIPTION OF THE INVENTION

The present invention may thus be understood specifically by reference to the drawings which illustrate various aspects of the invention as well as the best mode thereof and in which.

Figures 1, 2, 3, 4:
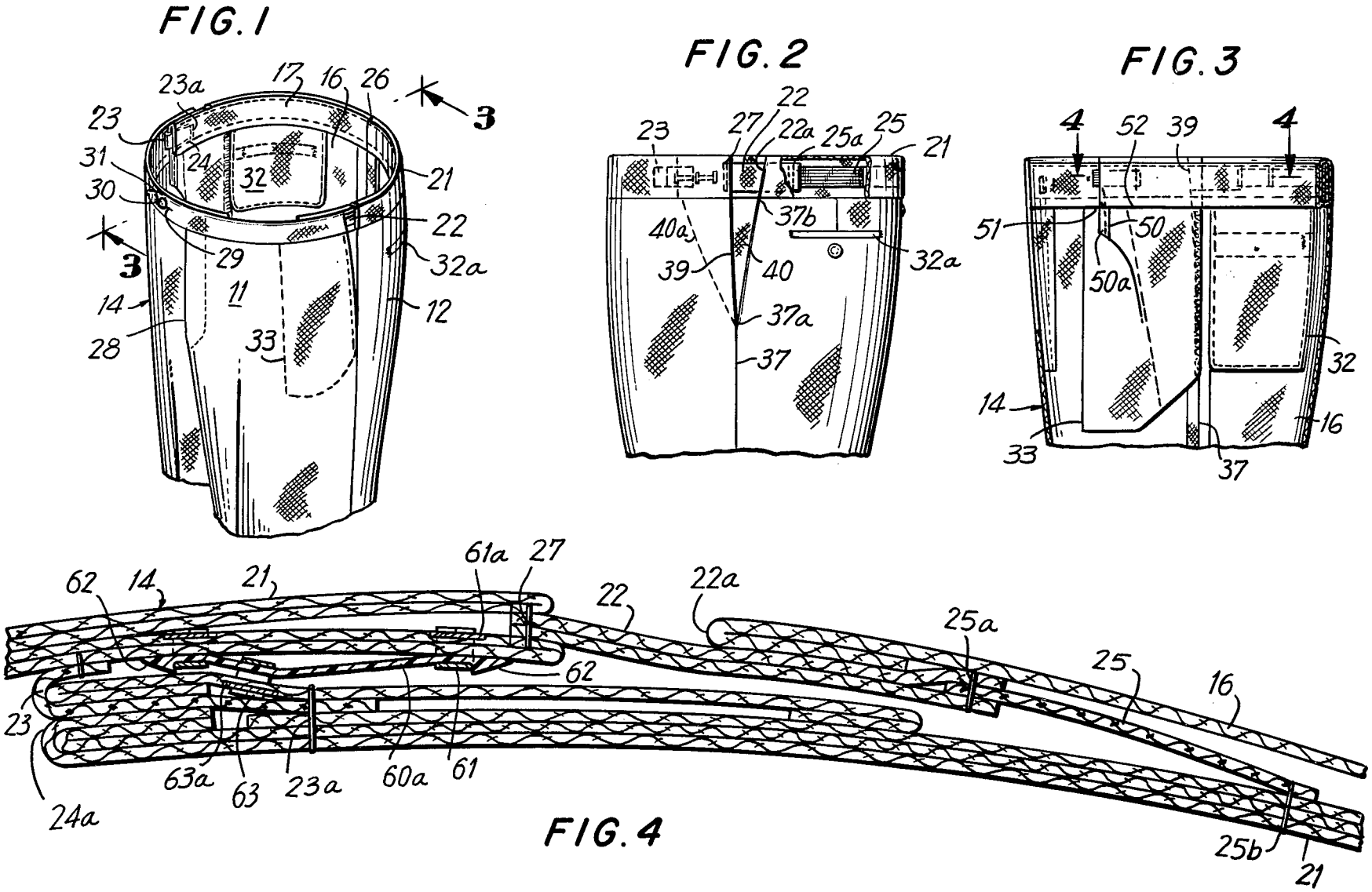
FIG. 1 is a perspective view of a pair of pants illustrating a split waistband construction.
FIG. 2 is a side view of a pair of split waistband pants illustrating the front and rear panel of the left leg of the pants and in a partial cutaway view, the elastic expandable material for allowing for the relative expansion of the front panel.
FIG. 3 is a partial cutaway view along line 3—3 of the pair of pants shown in FIG. 1 illustrating the present waistband as well as the overlapping relationship of the back panel and the front panel for a right leg of a pair of pants.
FIG. 4 is a section along the line 4—4 in FIG. 3 incorporating a further illustration of the present waistband construction for a right leg of a pair of pants.

Referring now to FIG. 1, it illustrates men's pants comprising a left pant leg front panel 11 and rear panel of the same pant leg shown as 12. The corresponding right pant leg front panel is shown as 14 and the rear panel as 16. The split waistband 21 incorporates an extension 22 for an outside (rear leg panel) elastic member 25 (shown in FIG. 2 in cutaway) and an inside (front leg panel) elastic member 23. The inside elastic member of band 23 is attached to the front panel 14 of the right pant leg, the other end of the elastic member is recessed into the waistband 21 in the interior thereof and fastened at **23*a* (also shown in FIG. 4) to the right pant leg rear panel 16. The elastic member 23 is inside a tunnel type construction 24 of the inside overlapping left rear panel 16 and this tunnel is shown by the phantom lines in FIG. 1 by the number 24, the opening for the same is shown as 24*a* in FIG. 4**.

Inasmuch as the waistband's 21 inside portion associated with the right rear panel 16 has a waistband skirt 17 (also, often being in conjunction with it, anti-roll stiffening—not shown), and as the element 17 runs the entire length of the back panel, i. e., from the overlapping portion thereof and terminates at the back seam 26, the inside elastic member 23 being attached at **23*a*** can effectively urge the rear panel forwardly.

The front panel 11 on the left pant leg is urged rearwardly by the outside elastic band 25 which, for appearance sake, may have an extension 22 of the same material as the pants. Attached to 22 is elastic member 25.

Figure 5:
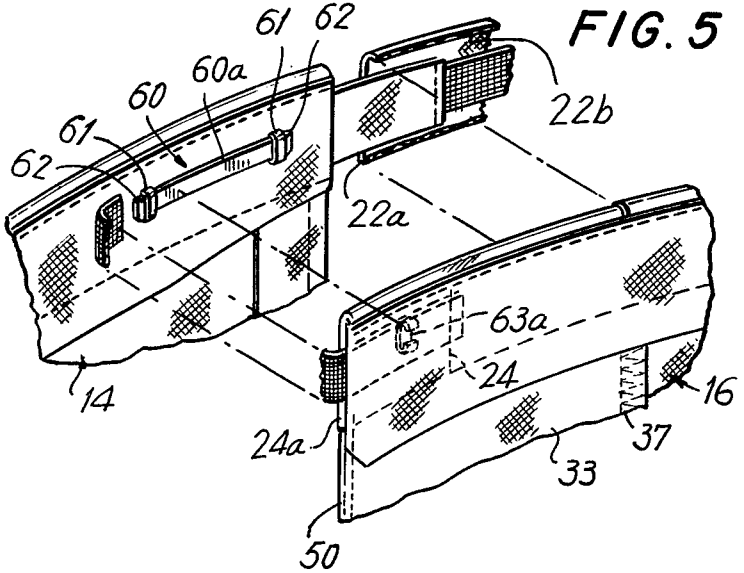
FIG. 5 is an assembly view of a slider device shown in phantom lines in FIG. 2 and shown in cross-section in FIG. 4.

The extension 22 may be attached to elastic member at 25a, or extension 22 may merely cover the elastic member 25 in the exposed portion between the split waistband. In the later event, the elastic member 25 is covered with the same fabric. The split waistband for the rear panel has a tunel opening 22a (shown in FIG. 4) and a tunnel 22b (shown in FIG. 5). If carried through extension 22, the elastic member 25 is attached at the tack point 27 shown in FIG. 2. The elastic member 25 is attached to the rear pant leg panel at 25b, as shown in FIG. 4. The split waistband 21 for the rear panel however is carried forwardly of the tunnel opening 22a and terminates in another tunnel 24 for said rear panel elastic member 23. (This construction is shown in FIG. 5.)

If the elastic member is attached at tack point 27, a stiffening member 27a (not shown) may be housed entirely within the fabric extension part 22 of the elastic member 25. As the elastic member is tacked down at 27, the stiffening member allows the cover material 22 to follow the expansions and retractions without bunching up. The stiffening member 27a is enveloped by the cover material. When entirely closed by the elastic members 23 and 25, the split waistband 21 shows very little, if any, of the extension part 22 unless the pants construction is that known as a "top pocket" model. Of course, an expansion of the waistline is accommodated by both the rear and front panels with the relative amounts depending on the wearer's body changes.

As further illustrated in FIG. 1, the front fly 28 has a fly tab 29 with a buttonhole 30.

A right rear pocket 32 and a left rear pocket 32a are shown in FIGS. 2 and 3 for the rear panels 12 and 16, respectively. A front pocket 33 is shown in FIG. 1 in phantom lines for the front panel 11 of the left leg. The front pocket construction, such as for pocket 33, (also known as a pocket bag) will be further explained herein. The left and right front pockets 33 are mirror images.

Pocket patch material 40 is used inside the front pocket bag 33 and forwardly of seam 37 and downwardly somewhat beyond junction point 37a to provide a neat appearance. The pocket bag 33 is held vertically to the front panel at side seam 37. Horizontally, pocket 33 is held to the waistband 21 from junction 37b forwardly.

As shown in FIG. 2, side seam 37 terminates at junction 37b, splitting into a side pocket opening 39, exposing pocket patch material 40. Seam 37 and the opening for tunnel 22a (shown in FIGS. 4 and 5) may not align with each other as shown in FIG. 1 or 2. For example, for a pants construction known as a top pocket model, the tunnel opening 22a may be forwardly of junction point 37b and pocket opening 39 may terminate at a point forwardly of tunnel opening 22a so as to provide an opening for the pocket such that the distance between 37b and 37a is about the same or shorter than the length of the pocket opening 39. For a top pocket model, pocket opening 39 may be in a form of a curve. With respect to the pocket construction for the top model, it is about the same, but patch material 40 may then be considerably larger in order to provide a neat appearance for the top part of the pocket that is not covered by front panel 11 and is positioned above pocket opening 39. For top pocket model, waistband 21 may be narrowed (necked down) and terminated as an extension 22 for the elastic member 25 with the narrowed extension 22 inserted in tunnel 22b and with the elastic member 25 being entirely within the tunnel 22b.

Front pocket patch material 40 extends forwardly, e. g., to seam 40a shown in FIG. 2.

The pocket bag 33 attachment to waistband 21 will be further explained herein.

The pocket opening 39 may have appropriate stiffening elements or stitching provided so as to give a neat appearance. A patch inside the pocket bag 33 and adjacent to the front panel 11 (not shown) extends forwardly and below point 37a and again assures adequate wear resistance and neat appearance to the pocket opening 39. The pocket opening 39 also defines the front panel 11 edge, at the pocket opening. This construction is again that conventionally found in the art.

Turning now to FIG. 3, it illustrates the interior portion of the right rear and front panels 14 and 16 with the pocket opening seam 39 shown in phantom lines. The pocket 33 construction shows a split seam 50 with a fold-over portion 50a. If needed, a straight, seamed split of adequate depth to provide expansion may also be used. For the front pockets, the split seam 50 expands with the waistband and, at the same time, provides sufficient anchoring of the pocket 33 to the front panel and the rear panel. Thus, the top pocket seam 51 anchors pocket bag 33 to the front panel 14 part of the waistband 21 with both the inside and outside plies of the pocket pouch 33 up to the split seam 50, and thereafter, with a single ply (outside ply) of the pocket bag 33. A single ply of the pocket, i. e., rearwardly of the split pocket seam 50, is anchored to the waistband for the rear panel at seam 52. The pocket bag 33 at the vertical seam thereof terminates at seam 37 and is attached to the front panel 14 and the waistband 21 thereof and pocket opening 39. As mentioned before, the split seam 50 for the pocket is sufficiently deep to provide for an adequate expansion of the waistline. This split seam may be positioned intermediate the two vertical edges of the pocket or it may be at the forward vertical edge of the pocket bag 33 such as for a top pocket bag. A sufficient fold 50a, if necessary, may further allow for an expansion of the waistband. An appropriate front pocket 33 is thereby defined.

When the pocket 33 is being filled, contrary to the prior art constructions, a slider device 60, shown in FIG. 4, in cross-section, or FIG. 5, in an assembly view, prevents the front pocket 33 from pulling the overlapped part of the rear panel 16, including the pocketing material 40, downwardly. Distortion of the pant leg is thereby prevented as the side slider device 60 rigidly restrains the pants even when the pockets are filled. However, the expandability of either of the pants or the pocket is not affected except insofar as limited by design as will be further explained herein.

The present invention is illustrated in FIG. 5 in an assembly view of the slider device 60. For ease of understanding, FIG. 5 should be considered together with FIG. 4. A plastic strap 60a is affixed at both ends thereof such as by an eye clamp 61, i. e., such as a clamp commonly used in combination with a hook to close a waistband at the top of the fly. However, the clearance to restrain from pulling out the built up end portions 62 of the strap 60a makes it necessary to clamp the eye clamp 61 somewhat tighter. The eye clamp 61 has a backing plate 61a with two openings into which the two prongs (not shown) of the eye clamp are inserted and bent down. In the illustration shown in FIGS. 4 and 5, the eye clamps 61 are positioned on the waistband 21 for the front panel 14 of the right pant leg with the sliding eye clamp 63 attached to the waistband for the overlapping back panel 16 of the right pant leg. Sliding eye clamp 63 has more clearance such as provided by appropriately dimensioned shoulders on the two prongs which engage its backing plate 63a thereby holding the eye clamp 63 sufficiently firmly (as it is well known in the art). However, eye clamp 61 also allows for some sliding of strap 60a because strap 60a is held restrainingly only at its ends.

Instead of using eye clamps 61, the plastic strap 60a may be affixed to the waistband 21 such as by sewing the plastic strap 60a thereto or by using ultrasonic welding of an underlying plastic boss (not shown) embedded in the waistband or by using different fastening means to attach the strap 60a to the front panel of the waistband. Use of the eye clamps 61 and 63 is preferred in attaching the strap 60a to the front and rear panels of the pant legs. The eye 63 runs for the desirable length along the strap 60a between the two eye clamps 61 placed on the waistband 21 for the front panel 14. The restraint imposed by the two terminal portions, i. e., eye clamps 61 and built up portions 62 of the strap 60a prevents the overstretching of the garment as well as supports the pocket contents. In addition, it allows equalization of expansion by the elastic members. Strap 60a also supports the overlapped portion of the rear panel 16 in the vicinity of the strap 60a and the rear panel 16 is thereby held restrainingly by the eye 63 without distending the elastic member 25. The strap 60a also prevents the rear panel 16 from saging and distending the elastic member 23 which is also a cause for an unsightly appearance. Of course, the placement of the plastic strap 60a can be reversed with the sliding eye clamp 63 being on the rear panel.

The advantages in the novel construction reside in using a strap 60a in combination with eye clamps 61 and 63 such that the weight of the pocket or any distortion, such as by placement of a hand in a pocket, will not unduly distend the inside, overlapped panel to render it unsightly. In addition, the strap 60a allows the extension of the waistband for a prescribed distance and thus assures that the strain caused by an undue extension does not affect the pocket opening 39 and seam 37 such as in the vicinity of the side seam termination point 37a shown in FIG. 3.

Instead of the construction as shown in FIG. 1 to FIG. 5, a further embodiment has also been found to be adaptable and useful with the side slider device arrangement shown in FIGS. 4 and 5. This embodiment is illustrated in FIGS. 6 and 7.

Figure 6:
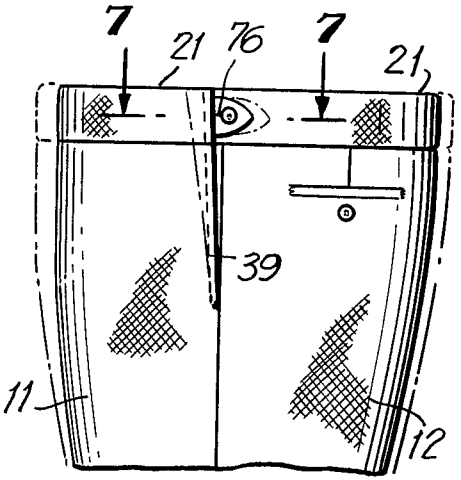
FIG. 6 is another embodiment of a split waistband construction for a left leg of a pair of pants.

For the pants as shown in FIG. 6, the left leg front panel 11 overlaps the rear panel 12. The rear panel 12 waistband 21 however does not carry in the waistband 21 the elastic member 25 as shown in the embodiment illustrated in FIG. 2. Instead, the arrangement of elastic members is shown in cross-section in FIG. 7 which is a simplified representation (such as omitting linings, stiffeners, etc.) of the waistband 21 along the lines 7—7 in FIG. 6. In this embodiment, elements which perform the same function have been labeled with the numbers corresponding to the elements shown in the embodiment illustrated by FIGS. 1 to 5.

Figure 7:
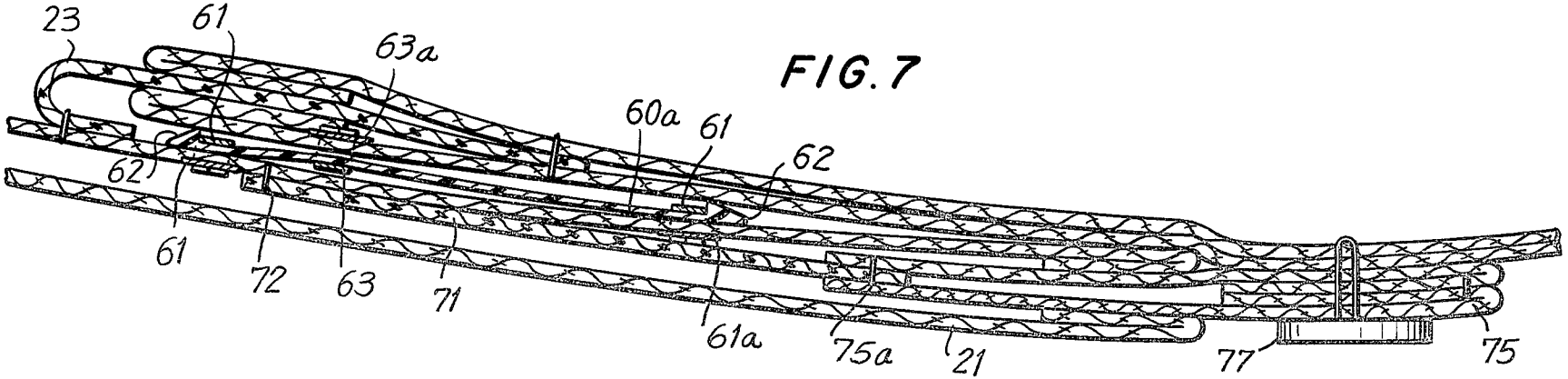
FIG. 7 is a cross-sectional view along lines 7—7 of FIG. 6.

As shown in FIG. 7, the elastic member 71 is housed within the waistband 21 of the front panel 11 for the left pant leg. The elastic member is attached at tack point 72 to the inside of the waistband material which may or may not be of the same type of fabric as used for the front panel 11. Conventionally, it may be an anti-roll (waistband) material. The elastic member is attached to an adjustment tab 75 at tack point 75a. The adjustment tab 75 has a buttonhole 76 for a button 77. Tab 75 may also have a stiffening element (not shown). For providing a further adjustment, the button(s) 77 may be placed at different locations on the waistband 21 for the rear panel 12.

The various extended positions of the pocket opening 39 are shown in FIG. 6 by the phantom lines; similarly, an extended position for the tab 75 is shown by the same lines in FIG. 6. The pants construction for the attachment of the strap 60a for the embodiment shown in FIGS. 6 and 7 is reversed from that shown for the embodiment in FIGS. 1 to 5, i. e., attachment is to front panel 11. The pants as illustrated show a waistband without belt loops, however, belt loops may also be provided at appropriate intervals along the waistband.

In describing the various embodiments, it is to be understood that the construction details for the right leg and the left leg, being mirror images of each other, correspond accordingly. Further, in illustrating the invention, the detailed construction of the garment has been simplified as the minutia for the various features are known from the prior art.

What is claimed is:

1. A split waistband pants comprising a left pant leg and a right pant leg, and for each leg a front panel and a rear panel, said front and rear panels terminating in a split waistband, a split waistband portion for each of said panels, a pocket along an exterior seam between each of said front panels and rear panels, said pocket securedly attached to said waistband portions for said front panel and said rear panel with a split in said pocket pouch therebetween, said pocket further securedly attached to the front panel of said pant legs and to the rear panel of the pant leg at the side seam thereof, an elastic member in said waistband for said front panel secured at said waistband portion of said rear panel, an elastic member for said rear panel portion of said waistband secured at one end to the waistband portion of said front panel on an interior portion therefor and on the other end thereof terminating in the waistband portion of said waistband for the rear panel thereof, means for an unrestrained slidable attachment of each of said waistband portions for said rear panels and front panels to each other, and means for restricting said slidable attachment from slidably exceeding a predetermined limiting distance.

2. The split waistband pants as defined in claim 1, wherein said means for an unrestrained slidable attachment is responsive to occuring differences in length of said waistband in combination with said elastic members.

3. The split waistband pants as defined in claim 1 wherein said means for said slidable attachment include a strap member, a built up portion for said strap member at the terminal portions thereof, means for securing said strap member to said waistband at each end of said strap member proximate to the end of said strap member, and on the interior of said split waistband, means for slidably securing said strap member intermediate to the ends of said strap member to said split waistband on an opposite side of said split waistband in an adjoining position thereof for the split waistband at its front and rear panel portions thereby joining said portions to each other, said means for slidably securing said waistband portions to each other including means for preventing vertical displacement and means for limitingly restraining horizontal displacement of said adjoining portions of said split waistband.

4. The split waistband pants as defined in claim 1 wherein said elastic member for said front panel includes a cover therefor in an exposed section between said waistband for said front and said rear panels for said pants.

5. The split waistband as defined in claim 1 wherein said elastic member for said front panel has, as an extension therefor, said waistband for said front panels, said extension terminating into said waistband for said rear panel, said elastic member securely attached to said terminal rearward portion of said waistband for said front panel and within the split waistband for said rear panel.

6. The split waistband pants as defined in claim 1 wherein said elastic member for said front panel is within said split waistband portion for said front panel portion of said waistband.

7. The split waistband pants as defined in claim 5 wherein the elastic member for said front panel includes an extension therefor, and means for securing in various positions, said extension, to an exterior portion of said waistband for said rear panel of said pant legs.

* * * * *